United States Patent [19]

Hwaw et al.

[11] Patent Number: 4,768,137

[45] Date of Patent: Aug. 30, 1988

[54] SCREWDRIVER STRUCTURE WITH ILLUMINATING FUNCTION

[76] Inventors: Hong L. Hwaw, No. 569 Lun-Mei Rd.; Huo M. Chen; Tu C. Chen, both of No. 37 Chang-Hsin Rd., all of Chang-Hwa, Taiwan

[21] Appl. No.: 81,244

[22] Filed: Aug. 4, 1987

[51] Int. Cl.[4] ..... F21V 33/00; B25B 23/18

[52] U.S. Cl. ..... 362/120; 7/165

[58] Field of Search ..... 362/119, 120; 81/177.1; 7/165

[56] References Cited

U.S. PATENT DOCUMENTS

| | | | |
|---|---|---|---|
| 2,242,536 | 5/1941 | Montgomery | 363/120 |
| 2,706,769 | 4/1955 | Cook | 362/120 |
| 2,736,792 | 2/1956 | Freeland | 362/120 |
| 2,773,974 | 12/1956 | Markett | 362/120 |
| 3,185,832 | 5/1965 | Nagamori | 362/120 |
| 3,603,782 | 9/1971 | Wortmann | 362/120 |
| 3,919,541 | 11/1975 | Chao | 362/120 |
| 4,107,765 | 8/1978 | Singleton | 362/120 |
| 4,283,757 | 8/1981 | Nalbandian | 362/120 |

FOREIGN PATENT DOCUMENTS

| | | | |
|---|---|---|---|
| 2031316 | 4/1980 | United Kingdom | 81/177.1 |

*Primary Examiner*—Roscoe V. Parker

*Attorney, Agent, or Firm*—Holman & Stern

[57] ABSTRACT

A screwdriver structure with illuminating function wherein a set of battery is disposed into the slot inside the grip handle, a bulb is disposed into the body slot inside the transparent receptacle, and a desired screwdriver is installed in the mouth on said receptacle, so that the bulb can be turned on and off through moving a sliding block in favor of illumination for installing or removing some screws.

1 Claim, 6 Drawing Sheets

SCREWDRIVER STRUCTURE WITH ILLUMINATING FUNCTION

BACKGROUND OF THE INVENTION

It has been considerably widespread to use the screwdriver as a tool to install a screw into a mechanism or to remove same therefrom, so the practical value of screwdrivers plays a prerequisite role among all the hand tools. Since the shapes of screw heads vary such as among flat (−) and phillips (+), we have to prepare various screwdrivers with different shaped tips in order to deal with various screw heads. In view of that bringing a number of screwdrivers is rather troublesome and cumbersome, some ingenious men had designed a screwdriver with convertible tips in favor of convenient use and portability. However, when installing screws in a mechanism or removing same therefrom, we often feel that the required light is rather dim, and particularly at night when replacing a fuse, we have to prepare a flashlight or candle. Certainly it is very inconvenient to use the conventional screwdriver in these circumstances.

In view of the above and in order to eliminate the foregoing drawbacks, the present inventor developed a screwdriver structure with illuminating function through his wholehearted research.

The major object of the present invention is to offer a screwdriver structure with illuminating function wherein a screwdriver with desirably shaped tip is installed in the mouth on a transparent receptacle, and a bulb is secured in the body slot inside the said receptacle, a set of battery cells are fixed inside the grip handle, so that when requiring illumination for work, we can push a sliding block to light the bulb which can emit a halo in front of the receptacle in order to illuminate where a screw is to be installed or removed; or such a novel screwdriver can be solely used as a flashlight in case of darkness once in a while so as to achieve the purpose of convenient practice.

SUMMARY OF THE INVENTION

The present invention is related to a screwdriver structure with illuminating function wherein a bulb is installed in the body slot inside the transparent receptacle, a set of battery cells are disposed in the slot inside the grip handle cells, the bulb can be turned on or off through moving a sliding block, so that a halo can be generated in front of the said receptacle for illumination; in addition, a group of inserting members form a mouth at the top of said receptacle so as to firmly receive the desired screwdriver for operation; and the integral structure thereof is so characterized by the fact that such novel screwdriver can be used in dark places in order to step up its convenient practicability.

DETAILED DESCRIPTION OF THE PREFERRED EMBODIMENT

Figure 1:
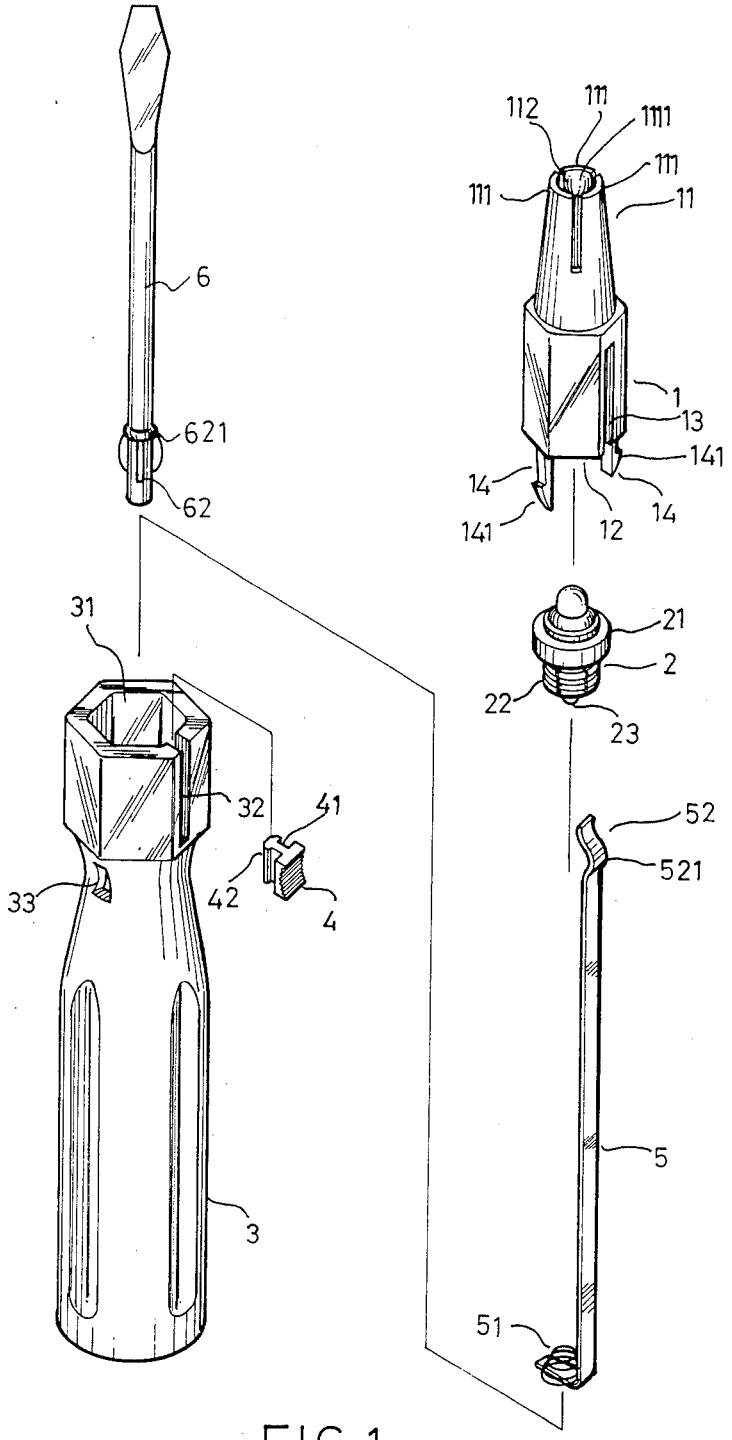
FIG. 1 is an exploded view of components of the present invention.
Figure 6:
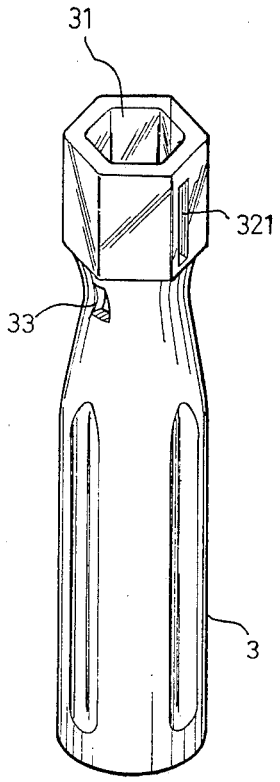
FIG. 6 is a perspective view showing another embodiment of a grip handle of the present invention.

As shown in FIG. 1, the transparent receptacle (1) is provided with a body slot (12) therein, a mouth (11) is formed by a group of inserting members (111) at the top thereof, and an opening (112) is formed by the mouth (11). A notch (1111) is provided in the inner wall of each inserting member (111) and, two opposite protruding legs (14) are provided at the bottom of said receptacle (1). The head end of said each leg (14) is designed into a reverse hook (141) and a guide slot (13) is provided in the receptacle (1); a slot (31) is provided inside the grip handle (3), and a guide slot (32) and two opposite holes (33) are provided in the upper part of said grip handle (3), or guide slot 32 may be replaced by a slot-like aperture 321 as shown in FIG. 6; a head end of a conducting member (5) is designed into a spring (51), and another head end (52) thereof is designed into a flange (521). In addition, a spacer block (41) is formed to extend from a sliding block (4), and an urging block (42) is provided on the head end of said spacer block (41). A bulb (2) is provided having an annular block (21). The inserting part (62) of screwdriver blade (6) is provided with a lug (621).

Figure 2:
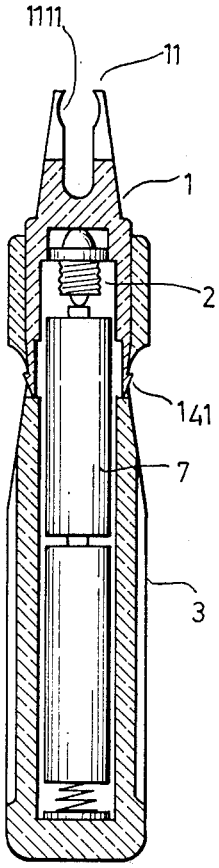
FIG. 2 is a cutaway view of the assembly of the present invention.
Figure 3:
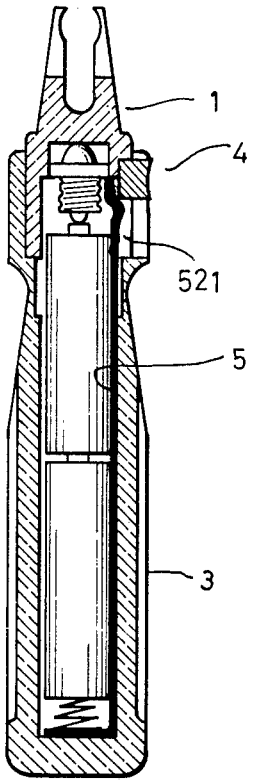
FIG. 3 is another cutaway view of the assembly of the present invention.

When the present invention is assembled as shown in FIGS. 2 and 3, the conducting member (5) is disposed into the slot (31) inside the grip handle (3), so that the spring (51) on the conducting member (5) is at the bottom of said slot (31) and the flange (521) at the head end of said conducting member (5) is just disposed at the guide slot (32) on said grip handle (3). The spacer block (41) of sliding block (4) is disposed into the guide slot (32) of FIG. 1 or forced into the slot-like aperture 321 of FIG. 6 so that the urging block (42) thereof is just urging against the head end (52) of said conducting member (5); then the bulb (2) is tightly fixed into the body slot (12) inside the receptacle (1) through the annular block (21), a set of battery cells (7) are disposed into the slot (31) inside the grip handle (3) so as to let the spring (51) on conducting member (5) contact the cathode of said set of battery cells (7); the bottom part of transparent receptacle (1) is disposed into the slot (31) inside the top part of grip handle (3), the reverse hooks (141) on the two legs (14) on said receptacle (1) are inserted into the two holes (33) on the grip handle (3) respectively; and meantime, the spacer block (41) on the sliding block (4) is disposed into the slot (13) to align with the slot (32), and the anode (23) of bulb (2) contacts the anode of the set of battery cells whereby (7), the present invention is well assembled.

Figure 4:
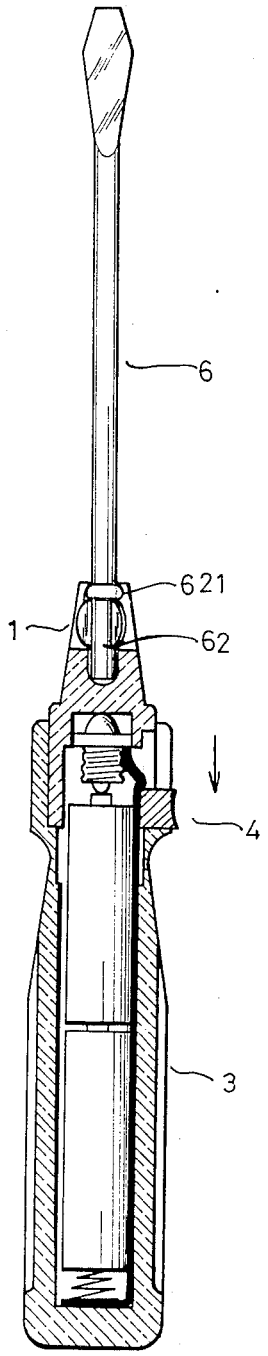
FIG. 4 is a sectional view of operating the present invention for illumination.
Figure 5:
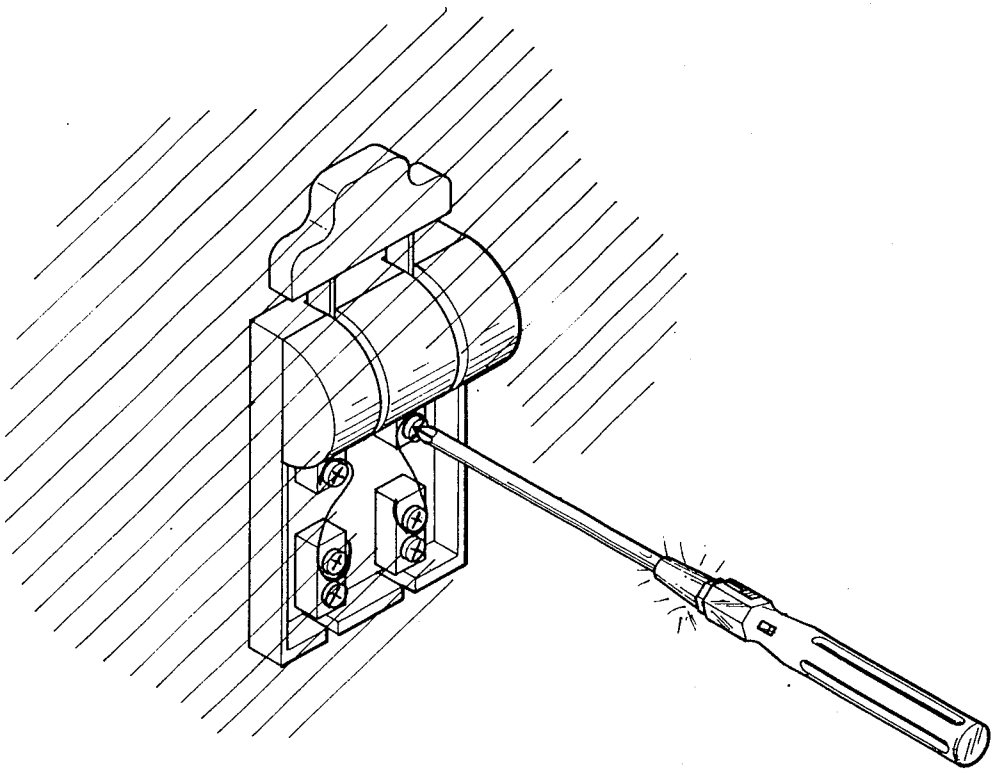
FIG. 5 is a perspective view of operating the present invention for illumination.

When using the present invention, as shown in FIGS. 4 and 5, the inserting part (62) of a required screwdriver blade (6) is tightly disposed into the opening (112) of said transparent receptacle (1), and the lug (621) on the inserting part (62) is disposed in the notch (1111) on the inner side surface of inserting member (111) of mouth (11) so as to secure the screwdriver (6) onto the transparent receptacle (1). In case of requiring illumination, all that is necessary to do is to push the sliding block (4) so that the urging block (42) urges against the flange (521) on the head end (52) of conducting member (5), and the said head end (52) contacts the cathode (22) of bulb (2), so that then a current loop is formed to light the bulb (2) and to form a halo in front of the transparent receptacle (1) for illumination.

We claim:

1. A screwdriver with illuminating function, comprising:

a grip handle having an opening therein for accommodating a battery, a guide slot being provided in an upper part of said grip handle, a pair of opposing holes being provided in said grip handle;

a conducting member disposed in the opening in the grip handle, one end of the conducting member being formed as a spring for making electrical contact with a battery accommodated in said opening, another end of said conducting member being formed as a flange;

a transparent receptacle body having an opening therein and a notched mouth portion forming an inserting member, a guide slot being formed in said receptacle body, and with a pair of opposing legs protruding from said receptacle body having ends thereof formed with hooks, said hooks being engageable in said holes in said grip handle for securing the body receptacle to the grip handle;

a bulb disposed in the opening in the body receptacle and in electric contact with the battery, said bulb having an annular block;

a screwdriver blade having an inserting part formed with a lug and insertable in the inserting member of the body receptacle; and a spacer block having a sliding block portion and an urging block portion, the spacer block being slidable in the guide slots of the grip handle and body receptacle for urging the flange end of the conducting member into electrical contact with the bulb for closing an electric circuit with said bulb and battery for illuminating said lamp.

* * * * *